US006385575B1

(12) United States Patent
Amada et al.

(10) Patent No.: US 6,385,575 B1
(45) Date of Patent: May 7, 2002

(54) CONSTRAINT RELIEVING VECTOR QUANTIZATION APPARATUS AND VECTOR QUANTIZATION METHOD HAVING CONSTRAINTS IN QUANTIZATION VECTORS

(75) Inventors: Tadashi Amada; Katsumi Tsuchiya, both of Kobe (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/293,878

(22) Filed: Apr. 19, 1999

(30) Foreign Application Priority Data

Apr. 20, 1998 (JP) ..... 10-109785

(51) Int. Cl.[7] ..... G10L 19/04
(52) U.S. Cl. ..... 704/222
(58) Field of Search ..... 704/222, 221, 704/220, 219

(56) References Cited

U.S. PATENT DOCUMENTS 5,481,642 A * 1/1996 Shoham ..... 704/219
5,819,213 A * 10/1998 Oshikiri et al. ..... 704/222

FOREIGN PATENT DOCUMENTS

| | | |
|---|---|---|
| EP | 0 577 488 | 1/1994 |
| EP | 0 710 948 | 5/1996 |
| EP | 0 751 496 | 1/1997 |
| JP | 6-120841 | 4/1994 |
| JP | 2659605 | 6/1997 |

OTHER PUBLICATIONS

J.E. Luck, et al, 81st Meeting of the Acoustical Society of America, 1 page, "Speech Compression by Component Selection on the Frequency Domain", 1971 (abstract only).

* cited by examiner

*Primary Examiner*—William Korzuch
*Assistant Examiner*—Donald L. Storm
(74) *Attorney, Agent, or Firm*—Oblon, Spivak, McClelland, Maier & Neustadt, P.C.

(57) ABSTRACT

A constraint relieving section receives an input vector and transforms it with a predetermined transform function to generate a target vector obtained by subtracting a constraint vector representing a predetermined constraint from the input vector. An error evaluation section selects from a codebook a code vector constituting a quantization vector having a minimum error with respect to the target vector and outputs an index representing this code vector.

20 Claims, 7 Drawing Sheets

CONSTRAINT RELIEVING VECTOR QUANTIZATION APPARATUS AND VECTOR QUANTIZATION METHOD HAVING CONSTRAINTS IN QUANTIZATION VECTORS

CROSS REFERENCE TO RELATED APPLICATIONS

This Application claims the benefit of the Japanese Patent No. 10-109785, filed Apr. 20, 1998, the entire contents of which are hereby incorporated herein by reference.

BACKGROUND OF THE INVENTION

The present invention relates to a vector quantization method used to quantize a linear predictive coefficient in speech encoding and, more particular, to a vector quantization method having constraints in quantization vectors.

A technique for performing linear prediction analysis of speech, decomposing the analysis result into a residual signal and a linear predictive coefficient representing a spectrum envelope, and processing them has been popular. A CELP (Code Exited Linear Prediction) scheme extensively studied recently in the fields of speech encoding is also based on the linear prediction analysis. A linear predictive coefficient and residual signal are quantized by VQ (Vector Quantization). In the CELP scheme, the linear predictive coefficient is often transformed into an LSP (Line Spectrum Pair) parameter, and then quantized. According to one of the reasons for this, stability of a synthesis filter can be easily discriminated.

In the CELP scheme, the synthesis filter is arranged on the basis of the LSP parameter on the decoding side. The quantized residual signal is passed through the synthesis filter to generate decoded speech. For this reason, unless the synthesis filter is stable, the decoded speech oscillates to greatly degrade the speech quality.

As is well known, if an LSP parameter $w=\{w_1, w_2, \ldots, w_p\}$ obtained by linear prediction analysis of degree p satisfies the following condition:

$$o<w_1<w_2<\ldots<w_p<\pi \quad (1)$$

the synthesis filter is stable. The order of magnitudes of components of the LSP parameter represented by condition (1) (to be referred to as an LSP parameter order hereinafter) is checked to allow easily determining the stability of the synthesis filter.

When an interval between the parameter components $w_1, w_2, \ldots, w_p$ decreases although the LSP parameter order is not reversed, the synthesis filter abruptly becomes unstable. Care must be taken for quantizing the LSP parameter components having small intervals. Small quantization errors generated by the LSP parameter components having small intervals greatly influence stability of the synthesis filter.

To solve the above problem, conventionally, a predetermined value D is defined for an interval between the adjacent LSP parameter components. When the interval between the adjacent components of the quantized LSP parameter is smaller than the predetermined value D, an appropriate countermeasure is made. Japanese Patent No. 2,659,605 (reference 1) describes a method of performing correction processing to increase a small interval between the adjacent components to assure the predetermined value D. This method is simple and easy, but distortion by correction processing is not evaluated in quantization.

Jpn. Pat. Appln. KOKAI Publication No. 6-120841 (reference 2) discloses a technique for solving the above problem. In reference 2, stability check and, as needed, correction processing are performed for each quantized LSP parameter obtained from a codebook. The distance between the corrected quantized LSP parameter and the input LSP parameter is calculated. With this technique, the distortion generated by correction processing can be included in quantization distortion and then evaluated, thereby improving quantization efficiency. According to this method, however, the calculation quantity increases because stability check must be performed for all quantized LSP parameters within the search loop of the codebook.

As described above, if a constraint such as the LSP parameter order or the interval between adjacent components is imposed on the quantization vector, it must be checked if the quantization vector satisfies the constraint after quantization or within the search loop of the codebook in order to assure stability of the synthesis filter. This check must desirably be performed in a smaller quantity of calculation. In particular, the calculation quantity increases with an increase in the number of candidates of the codebook in the check within the search loop. A small difference in calculation quantity becomes a large difference as a whole. A reduction in calculation quantity in the check is an important problem. According to the conventional methods, however, it is difficult to check if the quantization vector satisfies the constraint in a small calculation quantity, as described above.

In quantizing an LSP parameter upon nonlinear transform such as logarithmic transform, it is difficult to calculate the interval between the adjacent components in the transform range.

BRIEF SUMMARY OF THE INVENTION

It is an object of the present invention to provide a vector quantization apparatus capable of efficiently obtaining a quantization vector satisfying a constraint in a smaller calculation quantity and a vector quantization method therefor.

According to the present invention ,there is provided a vector quantization apparatus comprising a codebook which stores a plurality of code vectors; a constraint relieving section which relieves a predetermined constraint imposed on a quantization vector from an input vector input to an input terminal to generate a target vector, a error calculating section which calculates an error between the target vector and a code vector extracted from the codebook, and an error evaluation section for evaluating this error, selecting from the codebook a code vector constituting an unconstrained quantized vector for approximating the target vector, and outputting an index representing the code vector.

According to the invention, there is provided a vector quantization method comprising quantizing an input vector upon appropriately transforming the input vector on an encoding side in advance, and transforming a decoding result in an inverse manner to the transform of the input vector to obtain a quantization vector satisfying a constraint, thereby reducing the calculation quantity as compared to the conventional case.

More specifically, on the encoding side, an input vector is transformed with a predetermined transform function to generate a target vector. At least one code vector constituting a first quantization vector that approximates this target vector is selected from a codebook, and an index representing the selected code vector is output. The transform function transforms the first quantization vector in an inverse manner to the transform of the input vector to generate a second quantization vector satisfying a predetermined constraint.

The decoding side receives the index representing at least one code vector constituting the first quantization vector that approximates the target vector generated by transforming the input vector with the predetermined transform function. This code vector is extracted from a codebook. The first quantization vector constituting the code vector is transformed in an inverse manner to the transform function to generate the second quantization vector. Note that the transform function is designed to allow the second quantization vector to satisfy the predetermined constraint.

The vector quantization method according to the present invention is particularly suitable for LSP parameter vector quantization. In quantizing an LSP parameter vector, an LSP parameter serves as an input vector on the encoding side. A constraint vector representing a predetermined constraint is subtracted from the input vector to generate a target vector. At least one code vector constituting a first quantization vector having a minimum error with respect to the target vector is selected from a codebook. An index representing the selected code vector is output. Note that the constraint vector is designed such that the interval between the adjacent components of the quantized LSP parameter constituting a second quantization vector generated by synthesizing the first quantization vector and the constraint vector has a predetermined value or more.

The decoding side receives the index representing at least one code vector constituting the first quantization vector having the minimum error with respect to the target vector obtained upon subtracting the constraint vector representing the predetermined constraint from the input vector made of the LSP parameter. This code vector is extracted from a codebook. The constraint vector is added to the first quantization vector made of this code vector to generate the second quantization vector. Note that the constraint vector is designed such that the interval between the adjacent components of the quantized LSP parameter constituting the second quantization vector is the predetermined value or more.

The vector quantization method according to the present invention is also applicable to LPC parameter predictive coding. In this case, on the encoding side, an LSP parameter serves as an input vector. A constraint vector representing a predetermined constraint is subtracted from the input vector to generate a target vector. At the same time, a predictive vector is generated using a vector obtained by subtracting the constraint vector from a previous quantization vector. At least one code vector synthesized with this predictive vector and constituting a first quantization vector having a minimum error with respect to the target vector is selected from a codebook. An index representing this code vector is output. Note that the constraint vector is designed such that the interval between the adjacent components of the quantized LSP parameter constituting the second quantization vector generated by putting together the first quantization vector and the constraint vector is a predetermined value or more in the same manner as described above.

The decoding side receives the index representing at least one code vector constituting the first quantization vector having the minimum error with respect to the target vector generated by subtracting the constraint vector representing the predetermined constraint from the input vector made of the LSP parameter. This code vector is extracted from a codebook, and at the same time, the predictive vector is generated using the vector obtained by subtracting the constraint vector from the past quantized vector. The first quantization vector is generated by synthesizing this code vector and the predictive vector. The first quantization vector and the constraint vector are synthesized to generate the second quantization vector. Note that the constraint vector is designed such that the interval between the adjacent components of the quantized LSP parameter constituting the second quantization vector has the predetermined value or more in the same manner as described above.

According to still another vector quantization method of the present invention, an LSP parameter serves as an input vector on the encoding side. A constraint vector representing a predetermined constraint is subtracted from this input vector. The difference is nonlinearly transformed to generate a target vector. The constraint vector is subtracted from a past quantized vector. The difference is nonlinearly transformed to generate a predictive vector. At least one code vector synthesized with this predictive vector and constituting a first quantization vector having a minimum error with respect to the target vector is selected from a codebook. An index representing this code vector is output. Note that the constraint vector is designed such that the interval between the adjacent components of the quantized LSP parameter constituting the second quantization vector generated by putting together the first quantization vector and the constraint vector is a predetermined value or more in the same manner as described above.

The decoding side receives the index representing at least one code vector constituting the first quantization vector having the minimum error with respect to the target vector generated by subtracting the constraint vector representing the predetermined constraint from the input vector made of the LSP parameter and nonlinearly transforming the difference. This code vector is extracted from a codebook, and at the same time, the predictive vector is generated using the vector obtained by subtracting the constraint vector from the past quantized vector and nonlinearly transforming the difference. The first quantization vector is generated by putting together this code vector and the predictive vector and then subjected to a nonlinear inverse transformation, and then the first quantization vector and the constraint vector are synthesized to generate the second quantization vector. Note that the constraint vector is designed such that the interval between the adjacent components of the quantized LSP parameter constituting the second quantization vector has the predetermined value or more in the same manner as described above.

As described above, according to the present invention, the input vector is transformed to relieve the predetermined constraint from the quantization vector in encoding. In decoding the quantization vector, the quantization vector is decoded and then transformed in an inverse manner to the transform in encoding the input vector to generate the quantization vector satisfying the constraint. Whether the quantization vector satisfies the constraint can be checked in a small calculation quantity.

More specifically, when LSP parameter vector quantization is taken into consideration, the constraint for keeping the interval between the adjacent components of the LSP parameter to the predetermined value must be imposed on the quantization LSP vector in addition to the condition of the LSP parameter order in order to assure stability of the synthesis filter. The calculation quantity necessary for checking if the latter condition is satisfied becomes an important problem. According to the present invention, this check can be performed by comparing the magnitudes of the adjacent components, thereby greatly reducing the calculation quantity.

In quantizing the LSP parameter upon its nonlinear transform such as logarithmic transform, the constraint is subtracted before the transform, thereby eliminating the calculation for the interval of the transformed LSP parameter in quantization.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The preferred embodiments of the present invention will be described with reference to the accompanying drawing.

(First Embodiment)

According to the first embodiment of the present invention will be described with reference to FIGS. 1 to 4.

Figure 1:
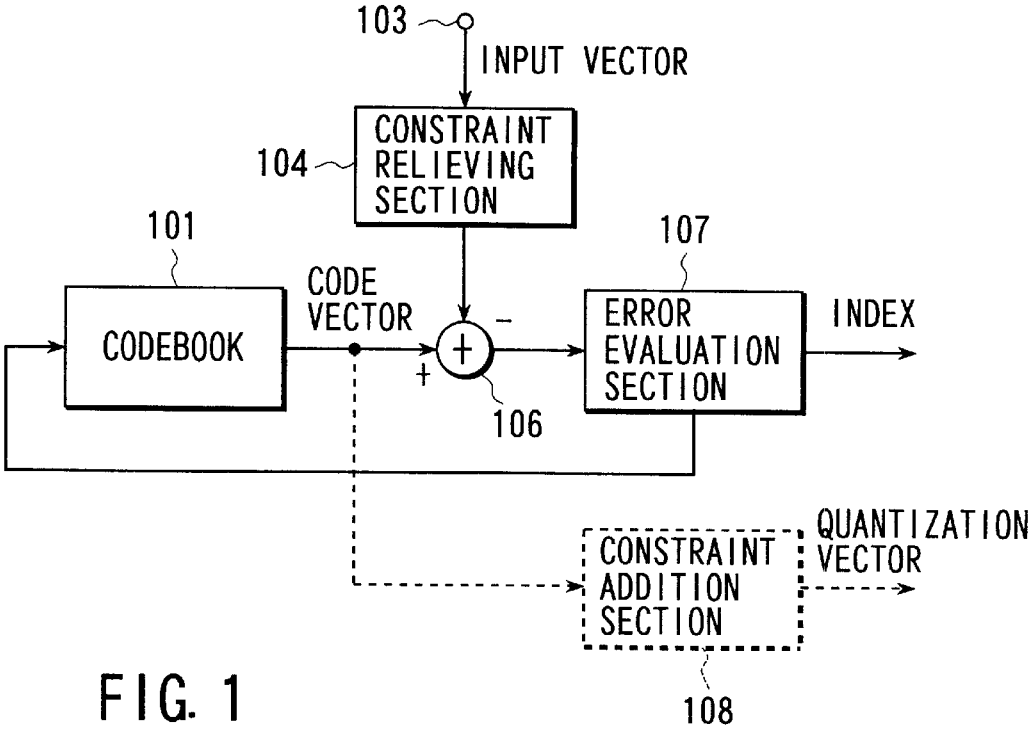
FIG. 1 is a block diagram showing the arrangement of an encoder in a vector quantization apparatus according to the first embodiment of the present invention.

FIG. 1 shows the arrangement of an encoder in a vector quantization apparatus according to the first embodiment. This encoder comprises a codebook 101 storing a plurality of code vectors, a constraint relieving section 104 for relieving a predetermined constraint imposed on a quantization vector from an input vector x input to an input terminal 103 to generate a target vector F(x), a subtracter 106 for calculating an error between the target vector F(x) and a code vector y[i] extracted from the codebook 101, and an error evaluation section 107 for evaluating this error, selecting from the codebook 101 a code vector y[i] constituting a quantized vector (to be referred to as an unconstrained quantized vector hereinafter) for approximating the target vector F(x), i.e., an optimal code vector, and outputting an index i representing the code vector y[i].

When a quantized vector is required in the encoder, a constraint addition section 108 is arranged to add the constraint relieved by the constraint relieving section 104 to the code vector y[i] to obtain the quantized vector.

The encoding processing sequence of the encoder shown in FIG. 1 will be explained using the flow chart of FIG. 2.

The constraint relieving section 104 transforms the input vector X using a transform function F for relieving the constraint imposed on the quantized vector to generate the target vector F(x) (step S11).

The error calculation section 107 calculates all the errors between the target vector F(x) and ith code vectors y[i] stored in the codebook 101 (step S12).

The error calculation section 107 outputs an index i of the code vector y[i] for the minimum error calculated in step S12 (step S13). This index i is transmitted to the decoder via a transmission path or storage medium.

Figure 3:
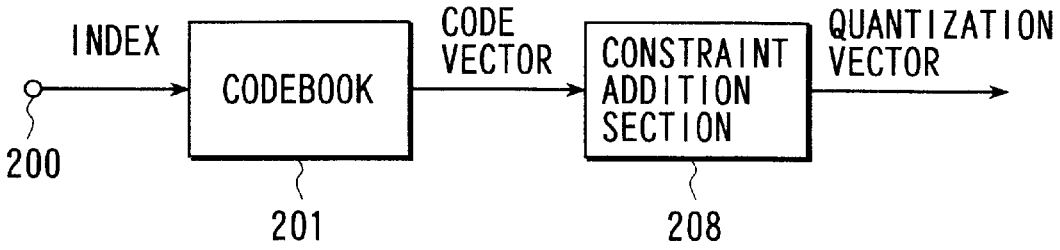
FIG. 3 is a block diagram showing the arrangement of a decoder in the vector quantization apparatus according to the first embodiment of the present invention.

FIG. 3 shows the arrangement of a decoder in the vector quantization apparatus according to the first embodiment. This decoder comprises a codebook 201 storing a plurality of code vectors, and a constraint addition section 208 for adding the constraint relieved by the constraint relieving section 104 in FIG. 1 to the code vector y[i] extracted from the codebook 201 in correspondence with the index i input from an input terminal 200, thereby generating a quantized vector. The codebook 201 is identical to the codebook 101 in the encoder shown in FIG. 1.

Figure 4:
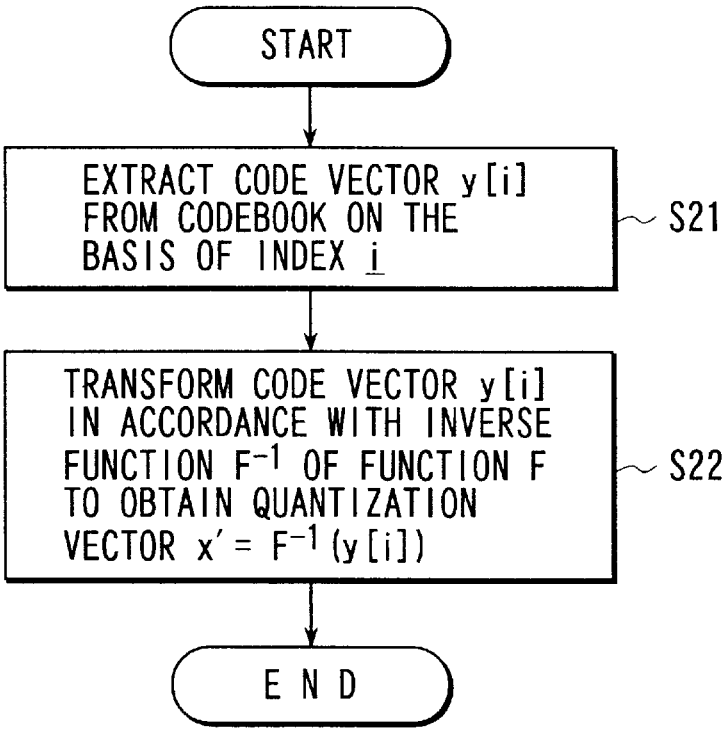
FIG. 4 is a flow chart showing a decoding processing sequence in the first embodiment.

The decoding processing sequence of the decoder shown in FIG. 3 will be described with reference to the flow chart in FIG. 4.

The decoder receives the index i transmitted from the encoder in FIG. 1. A code vector y[i] corresponding to this index i is extracted from the codebook 201 (step S21).

The code vector y[i] is transformed using a function $F^{-1}$ for adding the constraint, which is an inverse function of the transform function F for relieving the constraint. A quantized vector $x'=F^{-1}(y[i])$ satisfying the constraint is obtained as a decoded vector.

Only one codebook is used in this embodiment. When a plurality of codebooks are used, code vectors extracted from the respective codebooks are added to generate an unconstrained quantized vector. The error between the unconstrained quantized vector and the target vector is then calculated.

With the above arrangement, according to the vector quantization method of this embodiment, the quantized vector satisfying the constraint can be obtained in a small calculation quantity. This effect will be described in more detail with reference to the second embodiment to be described below.

(Second Embodiment)

A vector quantization apparatus according to the second embodiment of the present invention will be described with reference to FIGS. 5 and 6.

Figure 5:
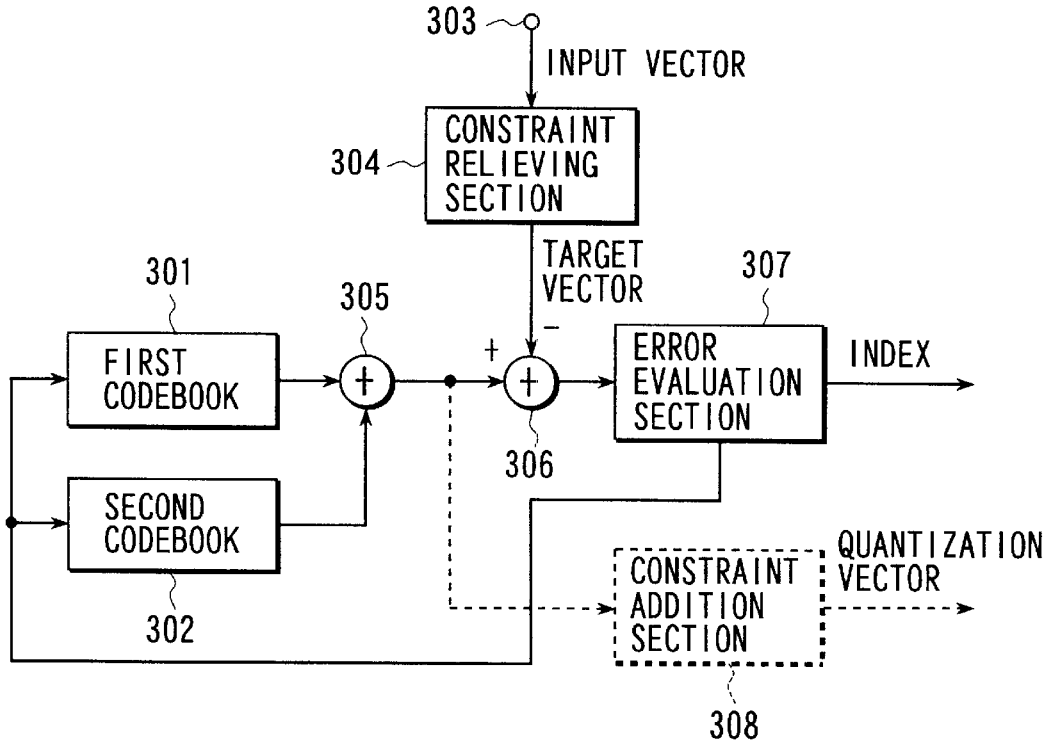
FIG. 5 is a block diagram showing the arrangement of an encoder in a vector quantization apparatus according to the second embodiment of the present invention.

FIG. 5 is a block diagram showing the arrangement of an encoder in a vector quantization apparatus according to the second embodiment. This encoder comprises first and second codebooks 301 and 302 each storing a plurality of code vectors, a constraint relieving section 304 for relieving a constraint from an input vector input from an input terminal 303 to generate a target vector, an adder 305 for adding code vectors extracted from the first and second codebooks 301 and 302 to obtain a quantized vector (unconstrained quantized vector) for approximating the target vector, a subtracter 306 for obtaining an error between the unconstrained quantized vector and the target vector, an error evaluation section 307 for evaluating this error, selecting an optimal combination of code vectors, and outputting an index representing the optimal combination of code vectors, and a constraint addition section 308 for adding the constraint to the unconstrained quantized vector to output a quantized vector. Note that the constraint addition section 308 can be omitted when no quantized vector is used in the encoder.

An LSP parameter is input to the input terminal 303 as an input vector. This LSP parameter is input to the constraint relieving section 304. The constraint relieving section 304 relieves the constraint imposed on the quantized LSP parameter, i.e., the constraint that the interval between the adjacent components of the quantized LSP parameter is a predetermined value D or more.

Constraint-relieved LSP parameter is used as a target vector to perform quantization. In this embodiment, two-stage vector quantization is performed. In two-stage vector quantization, the adder 305 adds code vectors extracted from the first and second codebooks 301 and 302 to generate an unconstrained quantized vector. The subtracter 306 calculates an error between the target vector and the unconstrained quantized vector. The error evaluation section 307 searches the first and second codebooks 301 and 302 for a combination of code vectors so as to minimize the error. Indices representing these code vectors are output. These indices are transmitted to the decoder via a transmission path or storage medium (not shown).

Figure 6:
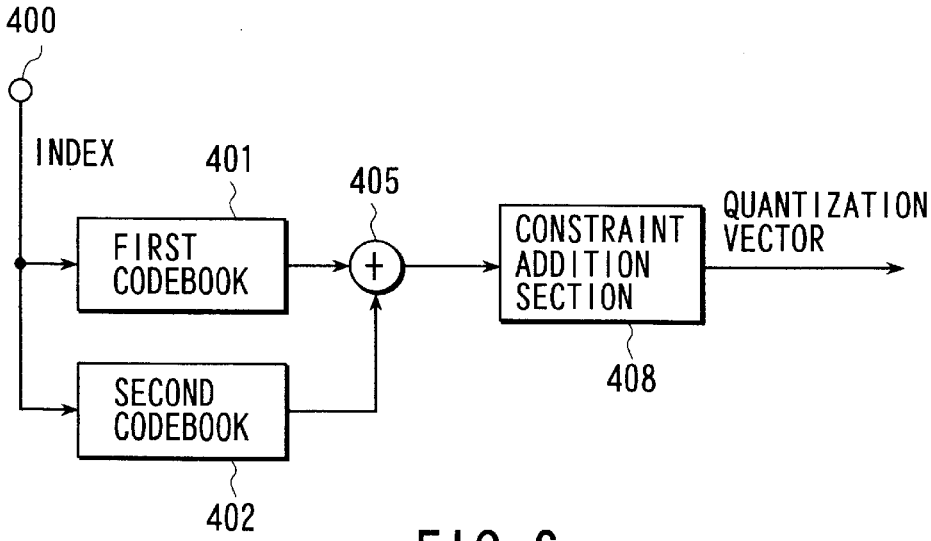
FIG. 6 is a block diagram showing the arrangement of a decoder in the vector quantization apparatus according to the second embodiment of the present invention.

FIG. 6 is a block diagram showing the arrangement of a decoder in the vector quantization apparatus according to this embodiment. This decoder comprises first and second codebooks 401 and 402 each storing a plurality of code vectors, an adder 405 for adding code vectors extracted from the first and second codebooks 401 and 402 in accordance with the indices input from an input terminal 400 to obtain an unconstrained quantized vector, and a constraint addition section 408 for adding a constraint to the unconstrained quantized vector to generate a quantized vector.

The indices transmitted from the encoder in FIG. 5 are input to the input terminal 400. Code vectors respectively corresponding to these indices are extracted from the codebooks 401 and 402. The adder 405 adds the extracted code vectors to generate an unconstrained quantized vector. This unconstrained quantized vector is input to the constraint addition section 408. The constraint addition section 408 adds the constraint relieved by the constraint relieving section 304 in FIG. 5 to the unconstrained quantized vector to generate a quantized vector. More specifically, the constraint addition section 408 increases the interval between the adjacent components of the unconstrained quantized vector by D.

With the above arrangement, the interval between the adjacent components of the LSP parameter as the input vector is reduced by D, and the interval is increased by D after quantization. The constraint that the interval between the adjacent components of the quantized LSP parameter is larger than D need not be taken into consideration in quantization. In particular, when the constraint is checked in the search loops of the codebooks 401 and 402, the calculation quantity can be greatly reduced.

As a detailed example of this embodiment, two-stage vector quantization of an LSP parameter $w=\{w_1, w_2, \ldots, w_p\}$ obtained by linear prediction analysis of degree p for the input vector will be described in detail below.

A quantized LSP parameter w' as a quantized vector is expressed using a first-stage code vector $w'_{a(i)}$ and a second-stage code vector w'b(j) as follows:

$$w'=w'_{a(i)}+w'_{b(j)};\ w'=\{w'_1, w'_2, \ldots, w'_p\} \tag{2}$$

In addition to the order condition (1), the LSP parameter w must have the constraint that the interval between the adjacent components of the LSP parameter is a predetermined interval D or more as follows:

$$w_{i+1}-w_i>D \tag{3}$$

In the codebook search according to a conventional vector quantization method, a combination of code vectors $w'_{a(i)}$ and $w'_{b(j)}$ having a minimum error with respect to the input LSP parameter w are selected from the codebooks, and i and j are output as indices. The quantized LSP parameter is obtained as $w'=w'_{a(i)}+w'_{b(j)}$. It should be noted that condition (3) may not hold depending on a combination of code vectors $w'_{a(i)}$ and $w'_{b(j)}$.

This does not occur in one-stage vector quantization. The codebooks are designed in advance to satisfy condition (3). In two-stage vector quantization, however, it is difficult to design the codebooks to cause a combination of two vectors to satisfy condition (3). In the conventional method, whether condition (3) holds must be checked within the quantization loop or after quantization. The total calculation quantity for this check is the sum of one subtraction and one comparison for each pair of adjacent components of the quantized LSP parameter according to condition (3).

To the contrary, in this embodiment, the input vector x is transformed using the following transform function:

$$F(x)=x-d$$

$$x=\{x_1, x_2, \ldots, x_p\}$$

$$d=\{0, D, 2D, \ldots, (p-1)D\} \tag{4}$$

and the unconstrained quantized vector is inversely transformed using the function $F^{-1}(x)$ given as follows:

$$F^{-1}(x)=x+d \tag{5}$$

Figure 2:
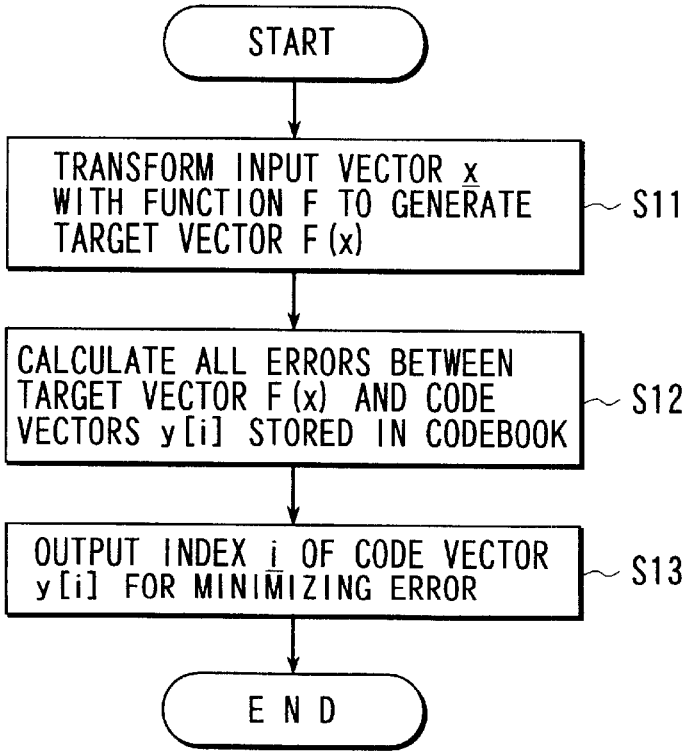
FIG. 2 is a flow chart showing an encoding processing sequence in the first embodiment.

In this case, F(x) is the function of reducing the interval between the adjacent components of the input vector x by D and is used in the constraint relieving section 104 in FIG. 1 (constraint relieving step S11 in FIG. 2). $F^{-1}(x)$ is the function of increasing the interval between the adjacent components of the unconstrained quantized vector by D and is used in the constraint addition section 208 in FIG. 3 (constraint addition step S22 in FIG. 4). d is the constraint vector obtained by expressing the constraint using a vector.

The interval between the adjacent components of the LSP parameter w serving as an input vector is reduced by D using the function F(x). After quantization, the interval between the adjacent components of the unconstrained quantized vector is increased by D using the function $F^{-1}(x)$. The constraint that the interval between the adjacent components of the quantized LSP parameter serving as the quantized vector is larger than D can be eliminated from the process, which is the characteristic feature of this embodiment.

In encoding, the constraint relieving section 304 uses the function F to transform the LSP parameter w serving as the input vector to the input terminal 303. The error evaluation section 307 selects code vectors $y'_{a(i)}$ and $y'_{b(j)}$ as a combination for minimizing an error between the unconstrained quantized vector from the adder 305 and the target vector F(w) generated by the above transform. The error evaluation section 307 outputs i and j as indices.

In decoding, code vectors $y'_{a(i)}$ and $y'_{b(j)}$ corresponding to the indices i and j input from the input terminal 400 are extracted from the codebooks 401 and 402. The adder 405 adds the extracted code vectors as follows:

$$y'=y'_{a(i)}+y'_{b(j)}$$

$$y'=\{y'_1, y'_2, \ldots, y'_p\} \tag{6}$$

thereby obtaining an unconstrained quantized vector y'. The constraint addition section 408 transforms this unconstrained quantized vector by the inverse transform $F^{-1}$ to obtain the quantized LSP parameter w' as follows:

$$w'=F^{-1}(y')=y'+d \tag{7}$$

As described above, according to this embodiment, the vector F(w) obtained by subtracting the constraint vector d from the input vector w is defined as the target vector, and the target vector is quantized. This is the largest difference from the conventional methods. With the above arrangement, whether the quantized vector satisfies the constraint can be checked in a small calculation quantity.

More specifically, the conventional method must check if condition (3) holds. That condition (3) holds is to satisfy the following condition in this embodiment:

$$y'_{i+1}>y' \tag{8}$$

That is, only one comparison is performed to check if condition (8) holds. The calculation quantity is reduced by one subtraction as compared with the check of condition (3).

As described above, according to this embodiment, one subtraction can be reduced for each pair of adjacent components in checking the interval between the adjacent components of the quantized LSP parameter. In addition, the reduction in calculation quantity is larger in the codebook search loop. An LSP parameter is normally quantized in about 20 to 30 bits. In 20-bit vector quantization (10 bits for the first stage and 10 bits for the second stage), after the search for the first stage is complete, the search for the second stage is started. In the search for the second stage, conditions (3) and (8) must be checked by the conventional method and the present invention, respectively. A candidate which cannot satisfy the condition may be excluded from the candidates (unconstrained quantized vectors described above) or corrected to satisfy the condition, and the search continues.

For example, a 10-dimensional LSP parameter has nine pairs of adjacent components. A 10-bit codebook (1,024 candidates) requires 9,216 (=9×1,024) check operations. In this embodiment, the calculation quantity is reduced once for each pair of adjacent components of the LSP parameter as compared with the conventional method as described above. Therefore, the calculation quantity is reduced by about 10,000 check operations as a whole, thus obtaining a great effect.

To reduce the calculation quantity, the check can be performed at the end of codebook search instead of the check within the codebook search loop. In this case, the condition does not hold, a previous quantization value must be used, or a quantization value must be corrected. The value d used in the transform function F is not limited to that defined by equation (4). Different values may be used in units of dimensions by an influence on speech quality or an encoding method.

(Third Embodiment)

A vector quantization apparatus according to the third embodiment of the present invention will be described with reference to FIGS. 7 and 8.

Figure 7:
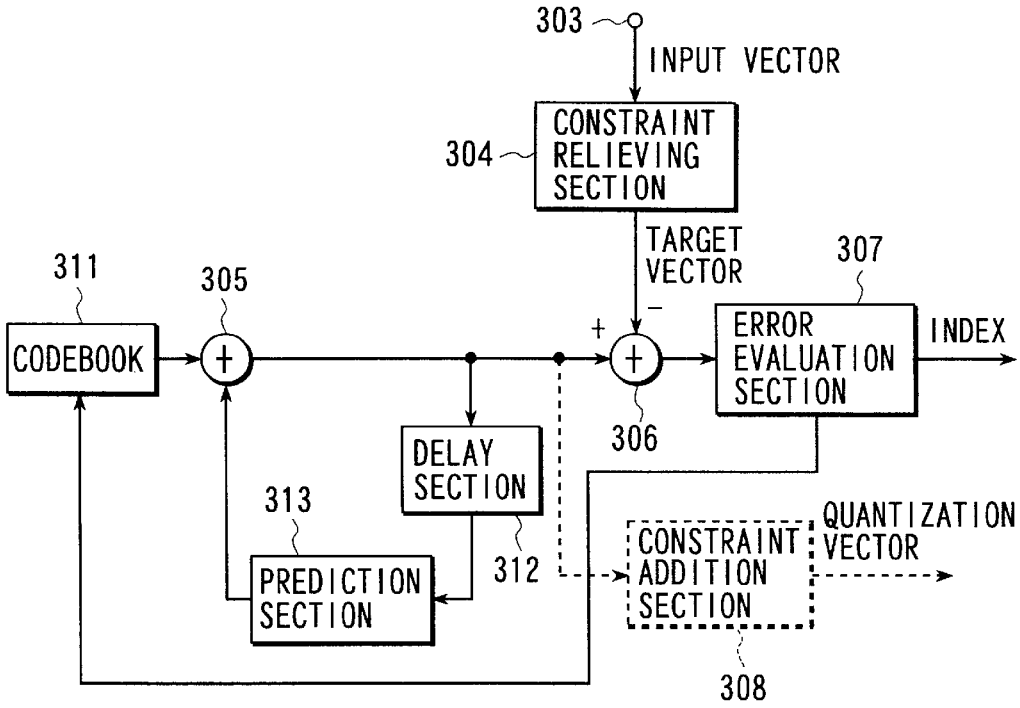
FIG. 7 is a block diagram showing the arrangement of an encoder in a vector quantization apparatus according to the third embodiment of the present invention.

FIG. 7 is a block diagram showing the arrangement of an encoder in a vector quantization apparatus. The same reference numerals as in FIG. 7 denote the same parts in FIG. 5, and the differences from the second embodiment will be mainly described. The encoder of the third embodiment is different from that of the second embodiment in that the first and second codebooks 301 and 302 in FIG. 5 are omitted, and a codebook 311, a delay section 312, and a prediction section 313 are arranged in FIG. 7.

The third embodiment exemplifies LSP parameter predictive coding. Predictive coding predicts a current LSP parameter based on a previous quantized LSP parameter and quantizes the difference from the actual LSP parameter, and transmits the quantization result. The following predictive coding is performed in FIG. 7.

An output from an adder 305 is input to the prediction section 313 via the delay section 312. The prediction section 313 generates the prediction value of the current LSP parameter. The adder 305 adds the prediction value to each code vector extracted from the codebook 311 storing a plurality of code vectors to generate an unconstrained quantized vector. A subtracter 306 calculates an error between the unconstrained quantized vector and the target vector as an output from a constraint relieving section 304. An error evaluation section 307 searches the codebook 311 for a code vector for minimizing the error and outputs an index representing this code vector. Each index is transmitted to the decoder via a transmission path or storage medium (not shown).

Figure 8:
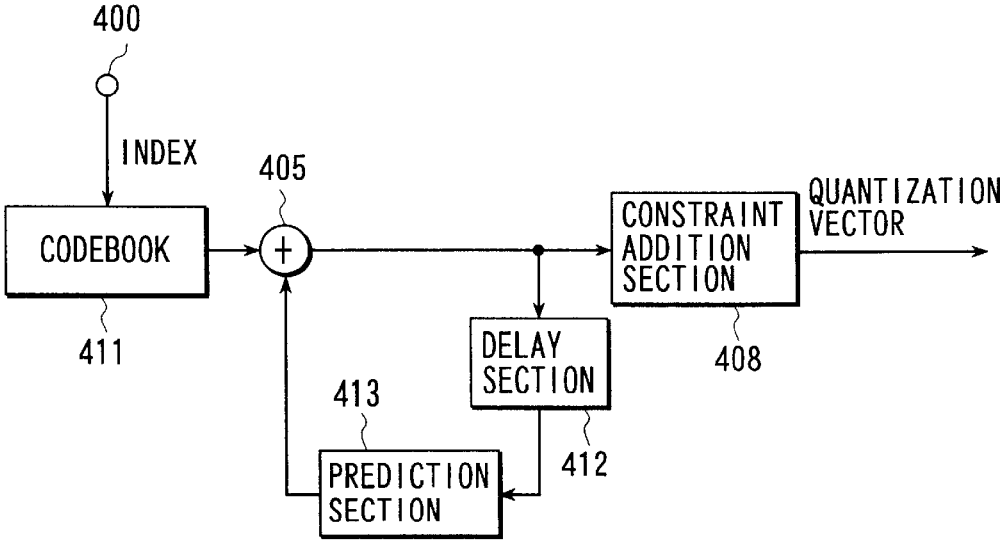
FIG. 8 is a block diagram showing the arrangement of a decoder in the vector quantization apparatus according to the third embodiment of the present invention.

FIG. 8 is a block diagram showing the arrangement of a decoder in the vector quantization apparatus according to this embodiment. The same reference numerals as FIG. 6 denote the same parts in FIG. 8, and differences from the second embodiment will be mainly described. The third embodiment is different from the second embodiment in that the first and second codebooks 401 and 402 in FIG. 6 are omitted, and a codebook 411, a delay section 412, and a prediction section 413 are arranged.

The index transmitted from the encoder in FIG. 7 is input to an input terminal 400. A code vector corresponding to this index is extracted from the codebook 411 storing a plurality of code vectors. An adder 405 adds this code vector to a prediction value obtained by the prediction section 413 on the basis of an output from the delay section 412, thereby generating an unconstrained quantized vector. This unconstrained quantized vector is input to a constraint addition section 408. The constraint addition section 408 adds the constraint relieved by the constraint relieving section 304 in FIG. 7 to the unconstrained quantized vector to generate a quantized vector.

As described above, this embodiment is effective even if the LSP parameter is predictive-coded. Vector quantization can be performed without considering the constraint as in the second embodiment.

In the third embodiment, the number of vectors stored in the delay sections 312 and 412, i.e., the degree of prediction is not limited to a specific value. When the degree of prediction increases, quantization precision can be improved accordingly. This embodiment can be applied to vectors regardless of the degree of precision. Examples of the prediction method are an MA (Moving-Average type) method and any other method in addition to the AR (AutoRegression) method used in this embodiment.

In the encoder (FIG. 7) of this embodiment, the output from the adder 303 is held by the delay section 312 and then input to the prediction section 313. However, an output from the constraint addition section 308 may be held by the delay section, the constraint may be relieved from the output from the delay section, and the constraint-relieved output may be input to the prediction section. In the encoder, the past quantized vector, i.e., the output from the constraint addition section 308 may be held by the delay section for the sake of processing convenience. According to this method, unlike in the arrangement in which the output form the adder 305 is stored in the delay section 312 (memory), an extra memory need not be added.

(Fourth Embodiment)

A vector quantization apparatus according to the fourth embodiment of the present invention will be described with reference to FIGS. 9 and 10.

Figure 9:
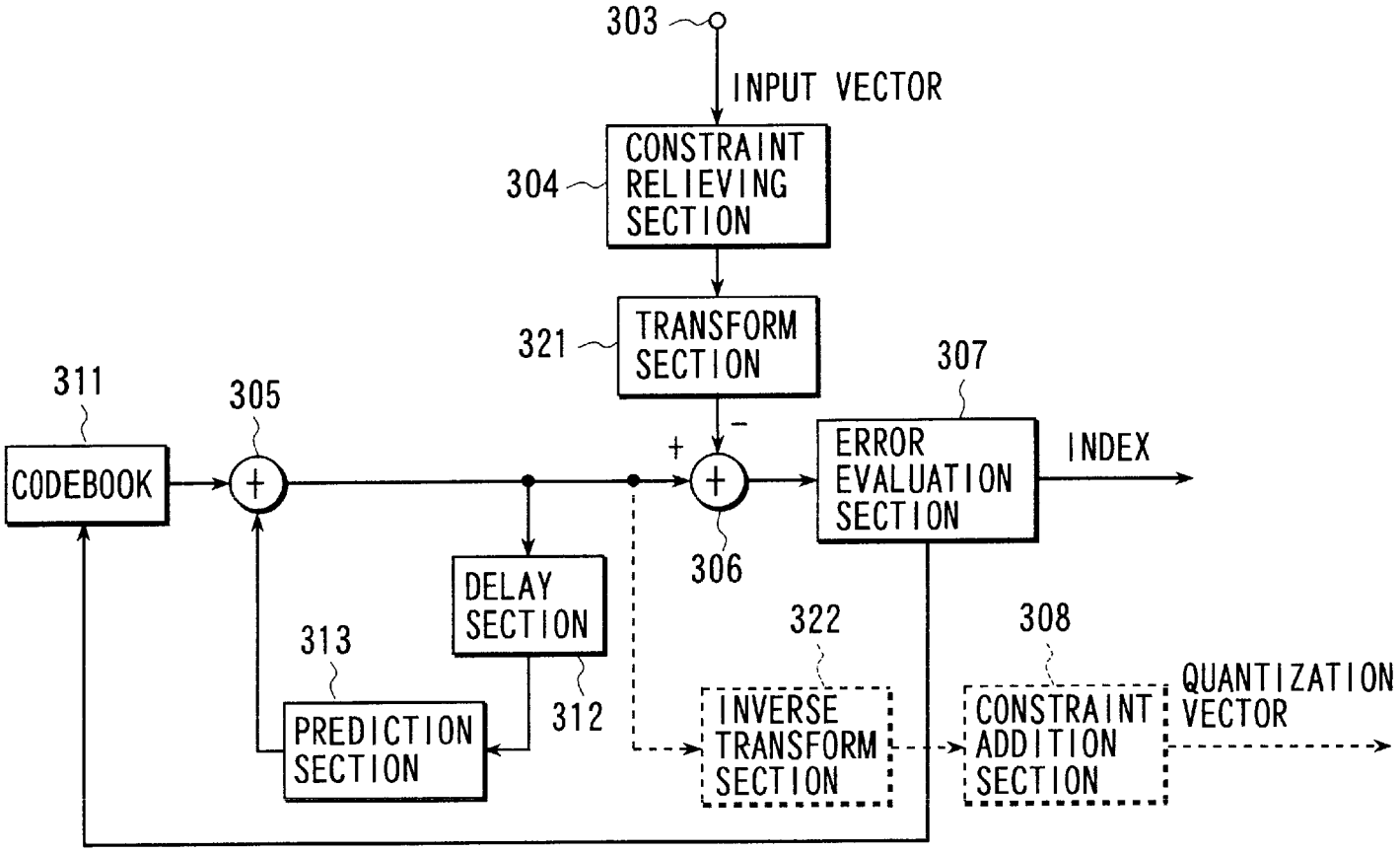
FIG. 9 is a block diagram showing the arrangement of an encoder in a vector quantization apparatus according to the fourth embodiment of the present invention.

FIG. 9 is a block diagram showing the arrangement of an encoder in a vector quantization apparatus according ton this fourth embodiment. The same reference numerals as in FIG. 7 denote the same parts in FIG. 9, and differences from the third embodiment will be mainly explained. The encoder of the fourth embodiment is substantially the same as that of FIG. 7 except that a transform section 321 and an inverse transform section 322 are added to the encoder of FIG. 7. A constraint addition section 308 can be omitted if no quantized vector is used in the encoder, as described above. In this case, the inverse transform section 322 is also omitted.

A constraint relieving section 304 relieves the constraint from an LSP parameter serving as an input vector input to an input terminal 303. The interval of the adjacent components of the constraint-relieved LSP parameter is reduced by D. The transform section 321 nonlinearly transforms the constraint-relieved LSP parameter into a target vector. The nonlinear transform in the transform section 321 is, for example, logarithmic transform, but is not limited to this. A code vector and a prediction value in the transform ranges are output from a codebook 311 and a prediction section 313, respectively. An adder 305 adds the code vector and prediction value to generate an unconstrained quantized vector in the transform range.

A subtracter 306 calculates an error between the unconstrained quantized vector and the target vector as the output from the transform section 321. An error evaluation section 307 searches the codebook 311 for a code vector for minimizing this error and outputs an index representing this code vector. Each index is transmitted to the decoder via a transmission path or storage medium (not shown).

Figure 10:
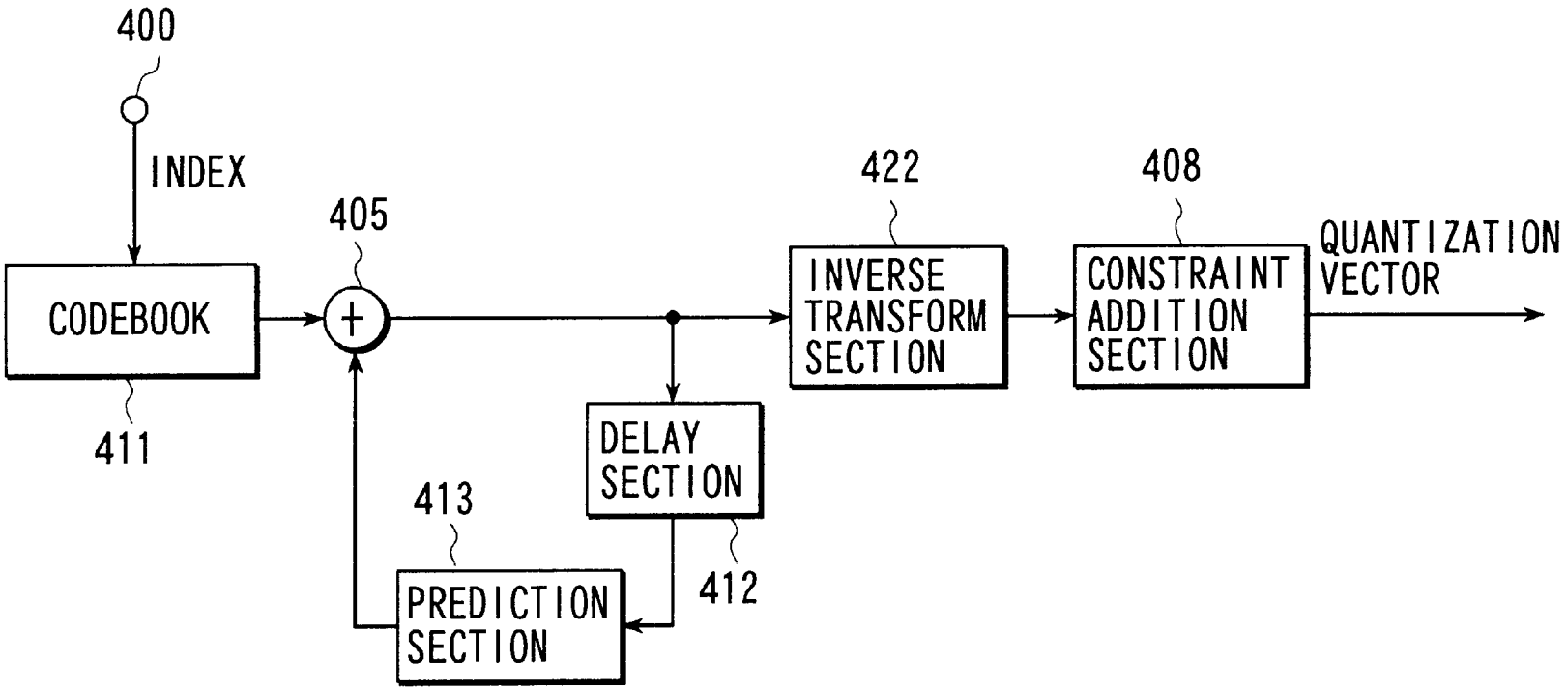
FIG. 10 is a block diagram showing the arrangement of a decoder in the vector quantization apparatus according to the fourth embodiment of the present invention.

FIG. 10 is a block diagram showing the arrangement of a decoder in the vector quantization apparatus according to the fourth embodiment. The same reference numerals as in FIG. 8 denote the same parts in FIG. 10, and differences from the third embodiment will be mainly explained. The decoder of this embodiment is substantially the same as that in FIG. 8 except that an inverse transform section 422 is added to the input of the constraint addition section 408 of the decoder of FIG. 8. The inverse transform section 422 is identical to the inverse transform section 322 in FIG. 9. The inverse transform section 422 performs inverse transform, e.g., inverse logarithmic transform, which is inverse to the transform of the transform section 321 in FIG. 9.

As will be described in this embodiment, the present invention is also effective in the transform region. This effectiveness will be described below.

Figure 11:
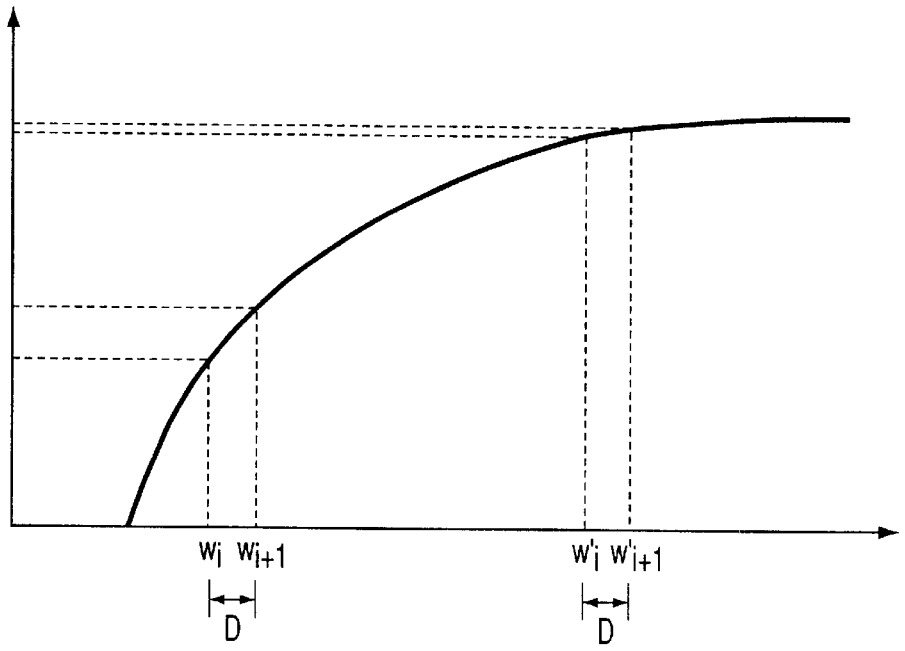
FIG. 11 is a graph for explaining LSP parameter nonlinear transform of the fourth embodiment.

It is difficult to satisfy the constraint that the interval between the adjacent components of the LSP parameter is D or more, in the nonlinear transform range of logarithmic transform or the like. The reason for this will be described with reference to FIG. 11. The LSP parameter is plotted along the abscissa in FIG. 11, and the LSP parameter in the transform range is plotted along the ordinate. The interval between the adjacent components, i.e., $w_i$ and $w_{i+1}$, and $w'_i$ and $w'_{i+1}$ of the LSP parameter is D. The intervals between the adjacent parameters in the transform range are not equal to each other. To quantize the LSP parameter in the transform range and keep the interval between the adjacent components of the LSP parameter to D or more, the intervals must be inversely transformed and evaluated. This requires a large calculation quantity and is not practical.

Figure 12:
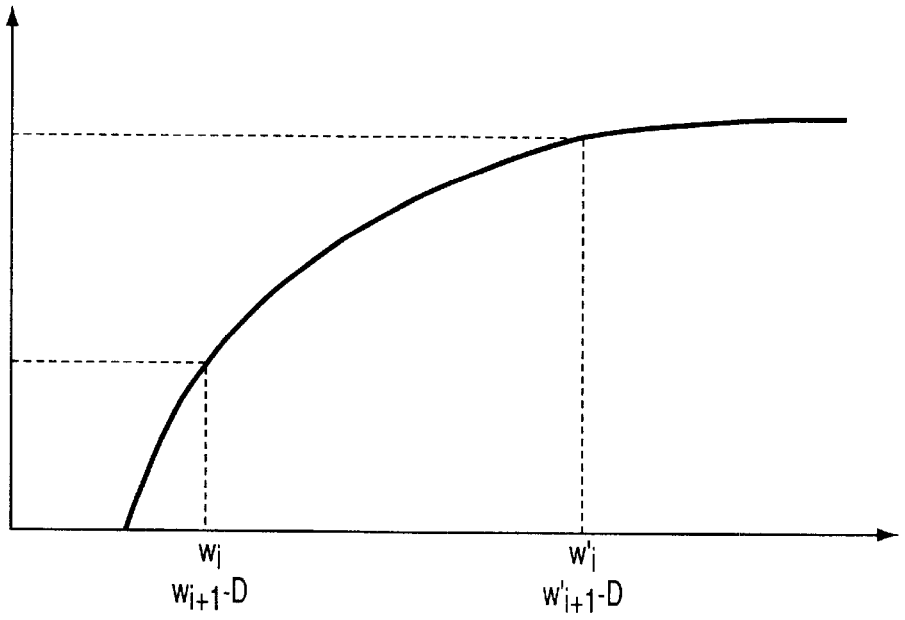
FIG. 12 is a graph for explaining an effect obtained by combining the constraint and LSP parameter nonlinear transform of the fourth embodiment.

To the contrary, in this embodiment, the constraint relieving section 304 reduces the interval between the adjacent components of the LSP parameter by D in advance, as shown in FIG. 12. Whether the order changes in the transform region determines whether the interval between the adjacent components of the LSP parameter is D or more.

To check the interval between the adjacent components of the LSP parameter, the conventional method requires the inverse transform in addition to the calculation for condition (3). Since the inverse transform generally requires a large calculation quantity, the calculation quantity further increases undesirably. To the contrary, according to this embodiment, only the check for condition (8) is performed in the transform range.

As described above, according to this embodiment, since the constraint relieving section 304 reduces the interval between the adjacent components of the LSP parameter serving as the input vector by D in advance, the interval between the adjacent components of the LSP parameter can be advantageously assured by checking only the order given by condition (8) even if quantization is performed after nonlinear transform such as logarithmic transform in the transform section 321.

As described above, according to the present invention, in decoding the input vector, the input vector is transformed to relieve the predetermined constraint from the quantized vector, and then the input vector is quantized. In decoding, after the quantized vector is decoded, and the decoded vector is transformed in an inverse manner to the transform in encoding the input vector to generate the quantized vector satisfying the constraint. Whether the quantized vector satisfies the constraint can be checked in a small calculation quantity. Vector quantization with a constrain can be efficiently performed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A vector quantization apparatus comprising:

a codebook which stores a plurality of code vectors;

a constraint relieving device which relieves a predetermined constraint imposed on a quantization vector from an input vector input to an input terminal to generate a target vector;

an error calculation device which calculates an error between the target vector and a code vector extracted from the codebook; and an error evaluation device which evaluates this error to select from the codebook a code vector making up an unconstrained quantized vector approximating the target vector, and outputs an index representing the code vector.

2. A vector quantization apparatus according to claim 1, which comprises a constraint adder arranged to add the constraint relieved by the constraint relieving device to the unconstrained quantized vector to obtain the quantized vector.

3. A vector quantization apparatus comprising:

a codebook storing a plurality of code vectors; and a constraint adder which adds the constraint relieved by a constraint relieving device to the code vector extracted from the codebook in correspondence with an index input from an input terminal, thereby generating a quantization vector.

4. A vector quantization apparatus comprising:

first and second codebooks, each storing a plurality of code vectors;

a constraint relieving device which relieves a constraint from an input vector input from an input terminal to generate a target vector;

an adder which adds code vectors extracted from the first and second codebooks to obtain an unconstrained quantized vector approximating the target vector;

an error calculation device which obtains an error between the unconstrained quantized vector and the target vector;

an error evaluation device which evaluates the error, obtained by the error calculation device, to select an optimal combination of code vectors, and outputs an index representing the optimal combination of code vectors.

5. A vector quantization apparatus according to claim 4, which includes a constraint adder which adds the constraint to the unconstrained quantized vector to output a quantization vector.

6. A vector quantization apparatus comprising:

first and second codebooks, each storing a plurality of code vectors;

an adder which adds code vectors extracted from the first and second codebooks in accordance with an index input from an input terminal to obtain an unconstrained quantized vector; and a constraint addition device which adds a constraint to the unconstrained quantized vector to increase the interval between the adjacent components of the unconstrained quantized vector.

7. A vector quantization apparatus comprising:

a codebook which stores a plurality of vectors;

a constraint relieving device which relieves a constraint imposed on an input vector input from an input terminal to generate a target vector;

a prediction device which predicts a current LSP parameter based on a previous quantized LSP (Line Spectrum Pair) parameter to generate a prediction value;

an adder which adds the prediction value and the code vectors extracted from the codebook to obtain an unconstrained quantized vector approximating the target vector;

an error calculator which obtains an error between the unconstrained quantized vector and the target vector;

an error evaluation device which evaluates the error, obtained by the error calculator, to select an optimal combination of code vectors, and outputs an index representing the optimal combination of code vectors.

8. A vector quantization apparatus according to claim 7, which includes a transformer which subjects the input vector from which a constraint is relieved to a nonlinear transform to generate a target vector, and an inverse transformer which subjects the unconstrained quantized vector to an inverse transform.

9. A vector quantization apparatus comprising:

a codebook which stores a plurality of code vectors;

a prediction device which predicts a current LSP (Line Spectrum Pair) parameter based on a previous quantized LSP parameter to generate a prediction value;

an adder which adds the prediction value and the code vectors extracted from the codebook in correspondence with an index input to an input terminal, to obtain an unconstrained quantized vector; and a constraint addition device which adds a constraint to the unconstrained quantized vector to increase the interval between the adjacent components of the unconstrained quantized vector.

10. A vector quantization method comprising:

transforming an input vector with a predetermined transform function to generate a target vector; and selecting at least one code vector making up a first quantization vector approximating the target vector from a codebook, to output an index representing the selected code vector, wherein the transform function is designed to generate a second quantization vector satisfying a predetermined constraint by transforming the first quantization vector using an inverse of the transform function.

11. A vector quantization method according to claim 10, wherein the selecting step includes calculating all the errors between the target vector and predetermined code vectors stored in the codebook and outputting an index of the code vector corresponding to the minimum error among the calculated errors.

12. A vector quantization method comprising:

inputting an index representing at least one code vector making up a first quantization vector approximating a target vector generated upon transforming an input vector with a predetermined transform function, and extracting the at least one code vector from a codebook; and transforming the first quantization vector made of the code vector using an inverse of the transform function to generate a second quantization vector, wherein the transform function is designed to allow the second quantization vector to satisfy a predetermined constraint.

13. A vector quantization method comprising:

defining an LSP (Line Spectrum Pair) parameter as an input vector and subtracting a constraint vector representing a predetermined constraint from the input vector to generate a target vector; and selecting from a codebook at least one code vector making up a first quantization vector minimizing an error with respect to the target vector; and outputting an index representing the selected code vector, wherein the constraint vector makes not less than a predetermined value an interval between adjacent components of a quantized LSP parameter making up a second quantization vector generated by putting together the first quantization vector and the constraint vector.

14. A vector quantization method according to claim 13, wherein the step of outputting an index includes adding code vectors extracted from the codebook to obtain an unconstrained quantized vector and searching the codebook for a combination of code vectors for which the error between the target vector and the unconstrained quantized vector becomes minimum, to output an index indicating the code vectors.

15. A vector quantization method comprising:

inputting an index representing at least one code vector making up a first quantization vector minimizing an error with respect to a target vector obtained by subtracting a constraint vector representing a predetermined constraint from an input vector made of an LSP (Line Spectrum Pair) parameter, and extracting the code vector from a codebook; and adding the constraint vector to the first quantization vector made of the code vector to generate a second quantization vector, wherein the constraint vector makes not less than a predetermined value an interval between adjacent components of a quantized LSP parameter constituting the second quantization vector.

16. A vector quantization method comprising:

defining an LSP (line Spectrum Pair) parameter as an input vector and subtracting a constraint vector representing a predetermined constraint from the input vector to generate a target vector;

generating a predictive vector using a vector obtained by subtracting the constraint vector from a past quantized vector; and selecting from a codebook at least one code vector making up a first quantization vector combined with the predictive vector and having a minimum error with respect to the target vector; and outputting an index representing the selected code vector, wherein the constraint vector makes not less than a predetermined value an interval between adjacent components of a quantized LSP parameter constituting a second quantization vector generated by putting together the first quantization vector and the constraint vector.

17. A vector quantization method according to claim 16, wherein the step of outputting an index includes adding code vectors extracted from the codebook to obtain an unconstrained quantized vector and searching the codebook for a combination of code vectors for which the error between the target vector and the unconstrained quantized vector becomes minimum, to output an index indicating the code vectors.

18. A vector quantization method comprising:

inputting an index representing at least one code vector making up a first quantization vector minimizing an error with respect to a target vector generated by subtracting a constraint vector representing a predetermined constraint from an input vector made of an LSP (Line Spectrum Pair) parameter, and extracting the code vector from a codebook;

generating a predictive vector using a vector obtained by subtracting the constraint vector from a past quantized vector;

combining the code vector and the predictive vector to generate the first quantization vector; and combining the first quantization vector and the constraint vector to generate a second quantization vector, wherein the constraint vector makes not less than a predetermined value an interval between adjacent components of a quantized LSP parameter constituting the second quantization vector.

19. A vector quantization method comprising:

defining an LSP (Line Spectrum Pair) parameter as an input vector, subtracting a constraint vector representing a predetermined constraint from the input vector, and nonlinearly transforming a difference to generate a target vector;

obtaining a predictive vector by using a vector obtained by subtracting the constraint vector from a past quantized vector and nonlinearly transforming a difference; and selecting from a codebook at least one code vector combined with the predictive vector to make up a first quantization vector minimizing an error with respect to the target vector, and outputting an index representing the selected code vector, wherein the constraint vector makes not less than a predetermined value an interval between adjacent components of a quantized LSP parameter constituting a second quantization vector generated by putting together the first quantization vector and the constraint vector and then performing a nonlinear inverse transformation.

20. A vector quantization method comprising:

inputting an index representing at least one code vector making up a first quantization vector having a minimum error with respect to a target vector generated by subtracting a constraint vector representing a predetermined constraint from an input vector made of an LSP (Line Spectrum Pair) parameter and nonlinearly transforming a difference, and extracting the code vector from the codebook;

generating a predictive vector using a vector obtained by subtracting the constraint vector from a past quantized vector and nonlinearly transforming a difference;

combining the code vector and the predictive vector to generate the first quantization vector; and combining the first quantization vector and the constraint vector and then performing a nonlinearly inverse transformation to generate a second quantization vector, wherein the constraint vector makes not less than a predetermined value an interval between adjacent components of a quantized LSP parameter constituting the second quantization vector.

* * * * *